US008944893B2

(12) United States Patent
Francois

(10) Patent No.: US 8,944,893 B2
(45) Date of Patent: Feb. 3, 2015

(54) DRESSABLE BONDED ABRASIVE ARTICLE

(75) Inventor: Emmanuel C. Francois, Taylors, SC (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 225 days.

(21) Appl. No.: 13/598,855

(22) Filed: Aug. 30, 2012

(65) Prior Publication Data

US 2013/0059511 A1 Mar. 7, 2013

Related U.S. Application Data

(60) Provisional application No. 61/528,861, filed on Aug. 30, 2011.

(51) Int. Cl.
*B24D 5/12* (2006.01)
*B24D 3/04* (2006.01)

(52) U.S. Cl.
CPC ..... *B24D 3/04* (2013.01)
USPC ..... 451/541; 451/542; 451/544; 451/547

(58) Field of Classification Search
CPC ..... B24D 5/12; B24D 18/00; B24D 5/00; B24D 5/16; C09G 1/02; C09K 3/1463; C09K 3/1409
USPC ..... 451/528–556; 51/307, 309
See application file for complete search history.

(56) References Cited

U.S. PATENT DOCUMENTS

| | | | | |
|---|---|---|---|---|
| 2,814,554 | A | 11/1957 | Rowe | |
| 3,210,892 | A * | 10/1965 | Perham | 451/342 |
| 3,482,791 | A * | 12/1969 | Alliegro | 241/296 |
| 3,802,130 | A * | 4/1974 | Lindenbeck | 451/544 |
| 3,868,793 | A * | 3/1975 | Corcoran et al. | 451/548 |
| 4,682,988 | A | 7/1987 | Narayanan et al. | |
| 4,913,708 | A * | 4/1990 | Kalinowski | 51/295 |
| 4,944,773 | A * | 7/1990 | Rue et al. | 51/307 |
| 5,007,943 | A | 4/1991 | Kelly et al. | |
| 5,139,539 | A | 8/1992 | Haynes, Jr. | |
| 5,318,605 | A * | 6/1994 | Carman | 51/308 |
| 5,876,470 | A | 3/1999 | Abrahamson | |
| 6,074,278 | A * | 6/2000 | Wu et al. | 451/28 |
| 6,093,092 | A * | 7/2000 | Ramanath et al. | 451/541 |
| 7,090,565 | B2 * | 8/2006 | Bonner et al. | 451/49 |
| 2005/0101237 | A1 * | 5/2005 | Vecchiarelli et al. | 451/548 |
| 2007/0074456 | A1 | 4/2007 | Orlhac et al. | |
| 2009/0088055 | A1 * | 4/2009 | Silva et al. | 451/541 |
| 2009/0093198 | A1 | 4/2009 | Subramanian et al. | |
| 2010/0190424 | A1 * | 7/2010 | Francois et al. | 451/548 |
| 2011/0177768 | A1 * | 7/2011 | Schudel | 451/548 |

* cited by examiner

*Primary Examiner* — George Nguyen
(74) *Attorney, Agent, or Firm* — Abel Law Group, LLP; Joseph P. Sullivan

(57) ABSTRACT

A dressable bonded abrasive article has a body that includes a bond material comprising an organic material and a blend of abrasive particles. The particles include a first type of abrasive particle comprising an oxide and having a first hardness and a first toughness; a second type of abrasive particle comprising an oxide and having a second hardness greater than the first hardness, and the second type of abrasive particle has a second toughness less than the first toughness; and a third type of abrasive particle comprising an oxide and having a third hardness greater than the first hardness and less than the second hardness, and the third type of abrasive particle has a third toughness less than the first toughness.

23 Claims, 4 Drawing Sheets

DRESSABLE BONDED ABRASIVE ARTICLE

This application claims priority to and the benefit of U.S. Provisional Patent Application No. 61/528,861, filed Aug. 30, 2011, and is incorporated herein by reference in its entirety.

BACKGROUND

1. Field of the Disclosure

The following is directed to an abrasive tool, and particularly directed to an abrasive tool having particular abrasive and performance variations.

2. Description of the Related Art

Abrasive grinding wheels are typically used for cutting, abrading, and shaping of various materials, such as stone, metal, glass, plastics, among other materials. Generally, the abrasive wheels can have various phases of materials including abrasive grains, a bonding agent, and some porosity. Depending upon the intended application, the abrasive wheel can have various designs and configurations.

For example, foundry floorstand grinding wheels are different than typical organic grinding wheels. Foundry wheels experience a dulling mechanism and need to be "dressed" on a regular basis during use. Although foundry wheels can be made to wear, such designs do not yield feasible results. Accordingly, the industry continues to demand abrasive wheels capable of improved performance.

SUMMARY

Embodiments of a dressable bonded abrasive article comprises a body including: a bond material comprising an organic material; a first type of abrasive particle comprising an oxide; a second type of abrasive particle comprising an oxide and different than the first type of abrasive particle; and the body may comprise an average metal removal capability of at least about 5 kg between dressings.

In another embodiment, the body may have an initial removal rate of at least about 2.4 $in^3$/min of material removed from a workpiece at about 25 psi pressure. The body also may comprise an average metal removal capability of at least about 4 kg of material removed between dressings at about 60 psi pressure, with a standard deviation of no more than about 2 kg. The average metal removal capability may be at least about 4% greater than that of a conventional foundry abrasive grinding wheel, wherein the conventional foundry abrasive grinding wheel comprises about 45% alumina zirconia and about 55% ceramic coated alumina. Other embodiments of the dressable bonded abrasive article for use in foundry grinding applications comprise a body with an initial removal rate that is at least about 8% greater than that of the conventional foundry abrasive grinding wheel.

Still another embodiment of a dressable bonded abrasive article comprises a body including: a bond material comprising an organic material; and a blend of abrasive particles comprising: a first type of abrasive particle comprising an oxide and having a first hardness and a first toughness; a second type of abrasive particle comprising an oxide and having a second hardness greater than the first hardness, and the second type of abrasive particle has a second toughness less than the first toughness; and a third type of abrasive particle comprising an oxide and having a third hardness greater than the first hardness and less than the second hardness, and the third type of abrasive particle has a third toughness less than the first toughness.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
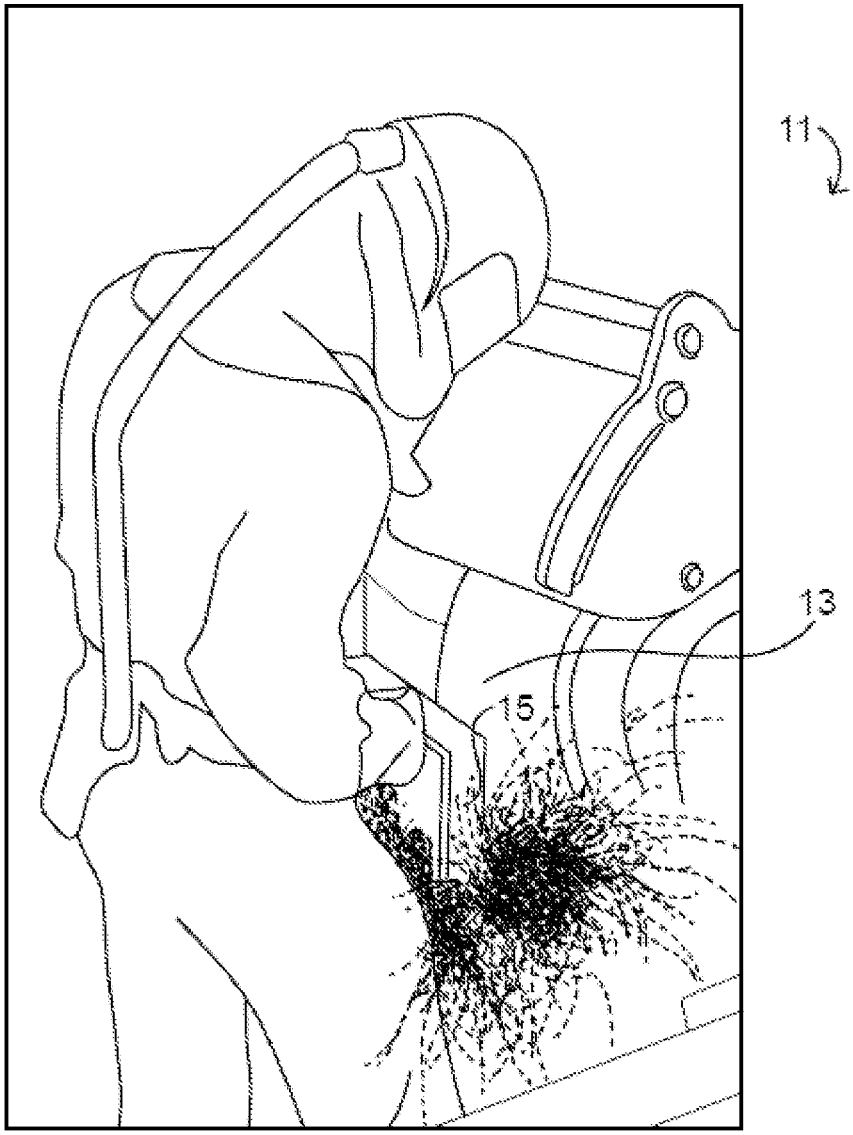
FIG. 1 is a depiction of a foundry grinding wheel and workpiece.
Figure 2:
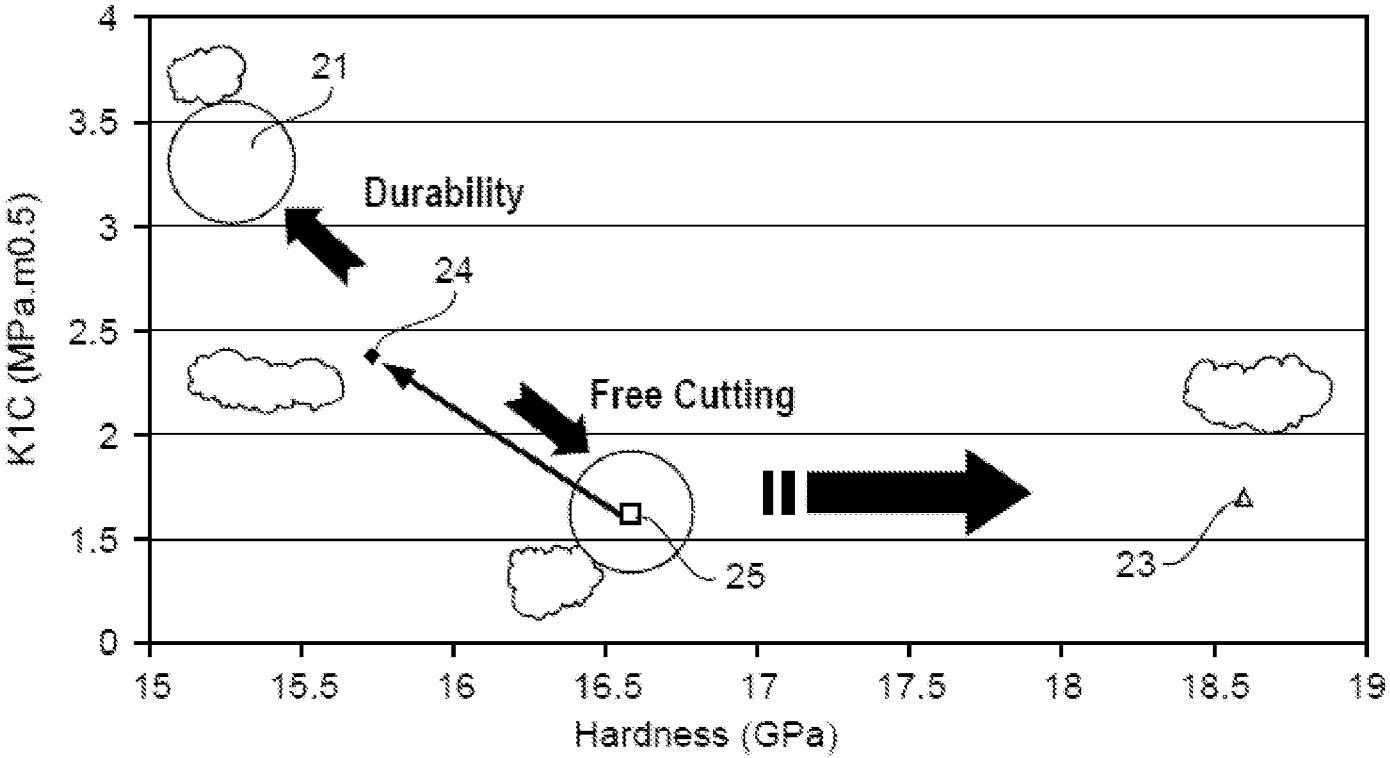
FIG. 2 is a plot of an embodiment of a composition of a dressable bonded abrasive article.

FIG. 1 depicts an exemplary foundry floorstand 11 having a dressable bonded abrasive article (e.g., a wheel 13). Wheel 13 is rotated at high speed to grind workpiece 15, which may be manually guided by an operator. FIG. 2 depicts an embodiment of components of wheel 13. For example, three different types of abrasive particles 21, 23, may be used to form wheel 13. Particles 21, 23, 25 may comprise an oxide, alumina, or consisting essentially of alumina (e.g., ceramic coated alumina), as are further described herein.

EXAMPLES

Test procedures were developed for a foundry floorstand. In these examples, two procedures can be defined. One of the procedures can include use of a stiff hydraulic piston to infeed the metal workpieces. This test is representative of a foundry operation operating with mechanical assistance, such as using a mechanical lever to feed a part into the wheel under a substantially constant force. Alternatively, another standardized procedure includes the use of a compliant pneumatic piston feed, which simulates grinding conditions of a hand-held operation, wherein an operator manually applies force to the workpiece to accomplish material removal operations.

Hydraulic Feed

A foundry grinding experiment with hydraulic feed was conducted with a floorstand grinder comprising a Setco Model SPL, Type 922-530-8 (30 HP). Grinding wheels having dimensions of 30 inches in diameter, 2-inch widths, and a 12 inch spindle size were place on the grinder and dressed with a Desmond Huntington Model 2 cutter, taking about 0.08 inches to about 0.12 inches off the radius to remove previous grinding history. The wheel speed was about 12,200 sfpm. The workpieces used were ductile iron bars having a 12 inch length and a 1 square inch cross sectional shape.

Using a hydraulic piston feed, the workpiece was plunged into the face of the wheel at a constant force in a range of about 50 to 70 (e.g., about 60) psi pressure. The grinding continued until about one linear inch of the workpiece was consumed, for a total stock removal of about 1 $in^3$. The workpiece was then weighed and remounted after a pause of about 10 seconds. This procedure was repeated two more times (i.e., for a total of three iterations per workpiece) before a new workpiece was used. Grinding for each wheel continued until its material removal rate (MRR) dropped below about 1.8 $in^3$/min, at which point the wheel was dressed.

There is some level at which an operator will dress a foundry wheel. For example, an operator may dress a wheel when the MRR drops to 50% of the initial grind. Accordingly, a line 31 (FIG. 3) may be drawn as being the point of re-dressing a wheel and the performance such as scatter or deviation may be measured at the crossing point.

Figure 3:
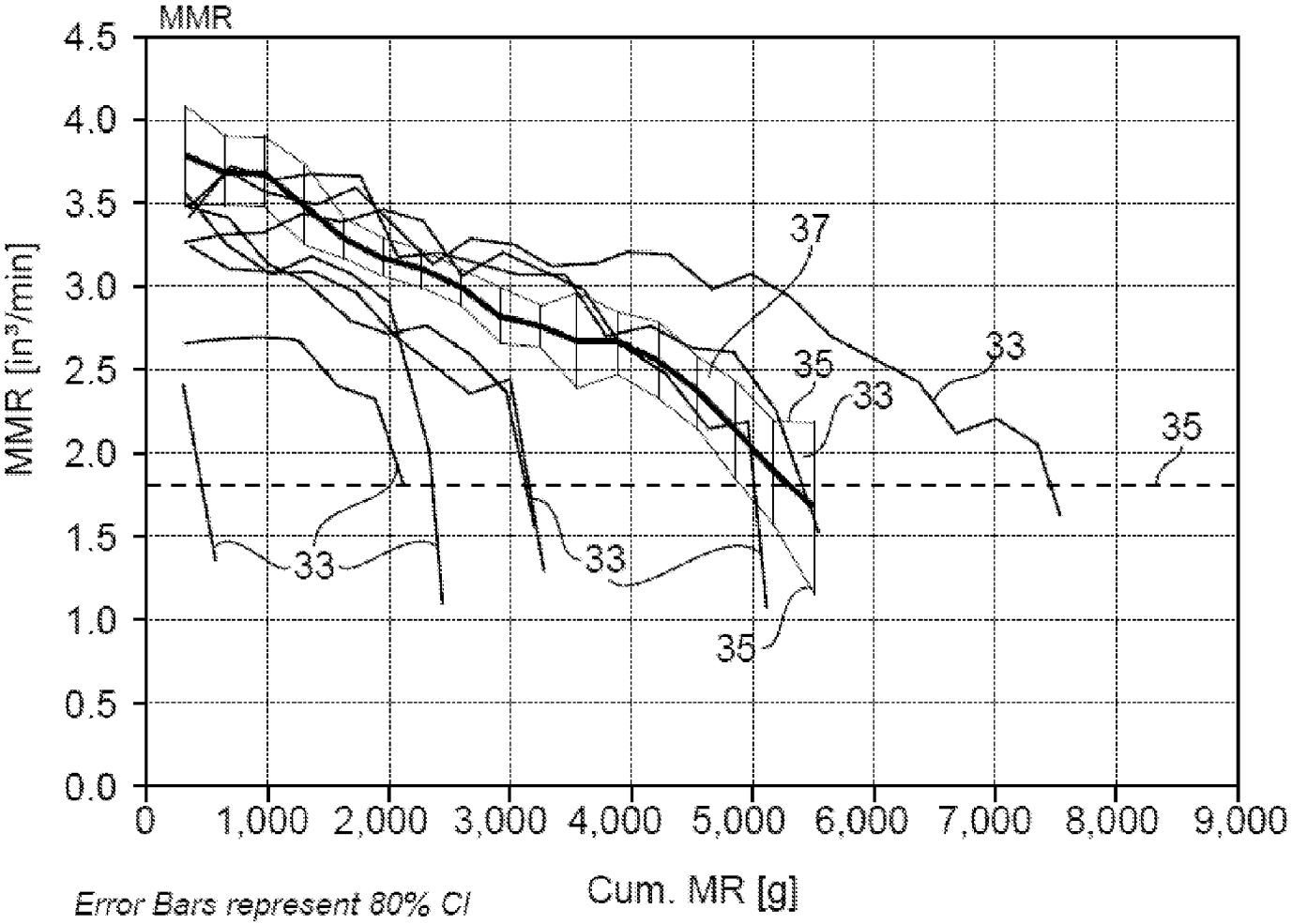
FIGS. 3 and 4 are plots of performance of embodiments of dressable bonded abrasive articles compared to conventional grinding wheels.

As shown in FIG. 3, lines 33 represent the performance of a standard or conventional wheel. After dressing, the standard wheel tends to dull quickly and the dulling tends to last longer. It is inconsistent. The lines 35 surrounding the area 37 represent the 80% confidence level for multiple tests of the embodiments of the wheel. The scatter in these embodiments between the dressings is much less than that for conventional wheels.

Figure 4:
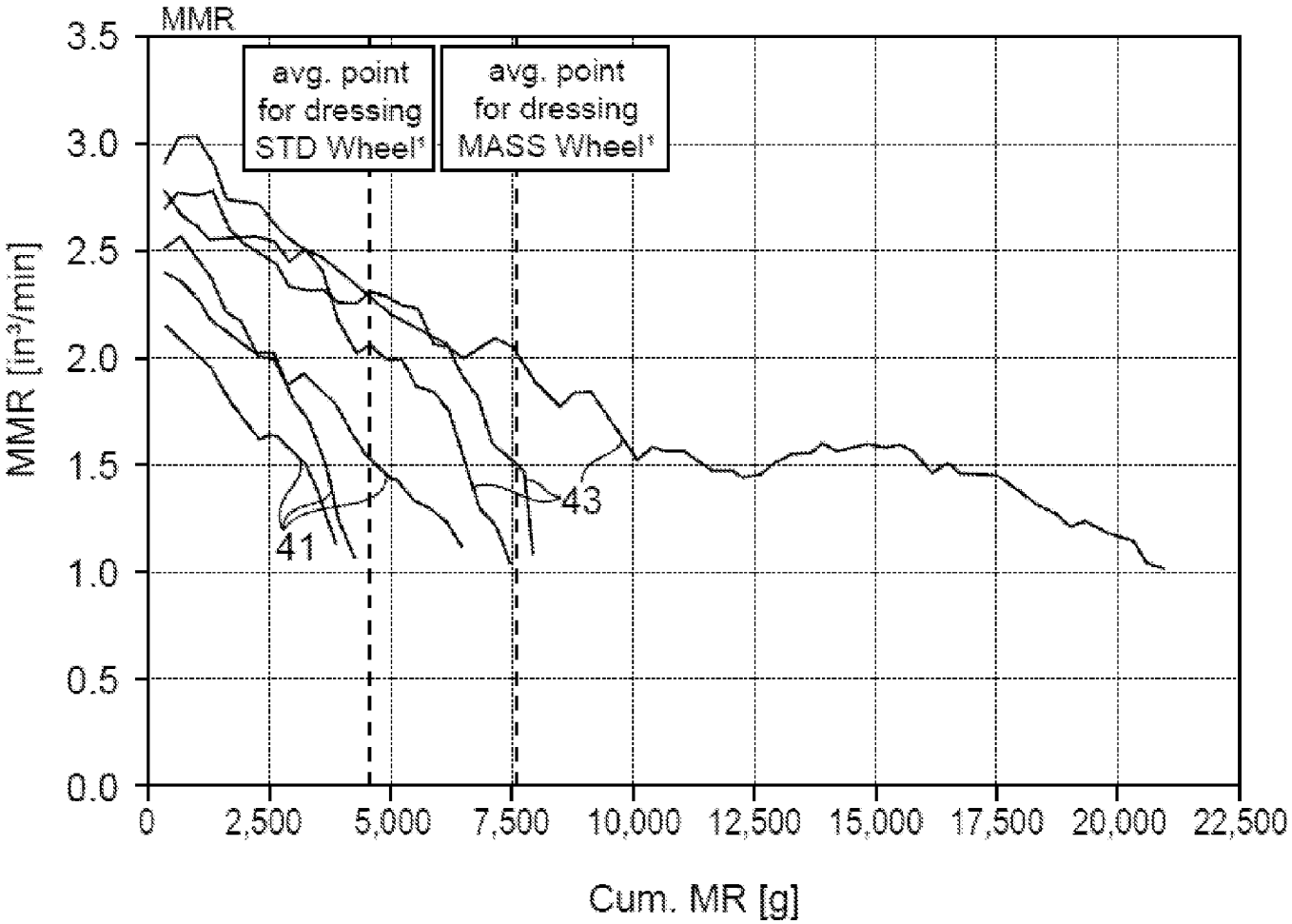

The data depicted in both FIGS. 3 and 4 was derived from the same sample types of conventional wheels and wheels according to embodiments herein. The conventional wheels comprised 54 vol % abrasive, 28 vol % bond and 18 vol % porosity. The bond comprised the following ingredients: 57 vol % Novolak resin 29-344, 12.5 vol % iron pyrite (CJD), 12.5 vol % potassium sulfate (CVR), and 18 vol % liquid Resole LPR5. The volume of abrasives in the conventional wheel included standard alumina-zirconia grain in grit sizes 10 and 12, respectively. Together these grains constitutes 45 vol % of the total abrasive grain volume. The conventional wheels also include standard alumina grain (57A iron-oxide (ceramic coated)) in grit sizes 14 and 16, respectively, for the remaining 55 vol % of the total abrasive grain volume.

The volume of abrasives in the wheels according to embodiments herein included alumina-zirconia grain in grit size 10, for 33 vol % of the total grain volume. A new alumina grain in grit size 12, also comprised 33 vol % of the total abrasive grain volume. In addition, a standard alumina grain (57A iron-oxide (ceramic coated)) in grit size 14 comprised 34 vol % of the total abrasive grain volume.

In this example, conventional wheels degrade below the MRR of about 1.8 $in^3$/min at an average cumulative metal removed of about 3.65 kg, with a standard deviation of about 2.21 kg. In contrast, embodiments cross the MRR at an average cumulative metal removed of about 5.32 kg, with a standard deviation of 0.42 kg.

This performance yields an improvement of at least 9%. This value may be calculated by comparing the material removed by the conventional wheel (about 3.65 kg) to that of embodiments disclosed herein. For example, when an embodiment removes 4.0 kg of material, a 9% improvement is effected, and when an embodiment removes 5.25 kg of material, a 44% improvement is effected compared to the conventional wheel removal rate.

Pneumatic Feed

This foundry grinding experiment with pneumatic feed was conducted with the same floorstand grinder and wheels described above. In this experiment, the wheels were first trued by hand with a Desmond Model 58R cutter, taking about 0.08 inches to about 0.12 inches off the radius to remove previous grinding history. The wheels were then dressed with a Desmond Huntington Model 2 cutter for about 20 seconds at about 65 pounds of force. The dresser traversed across the face at a rate of about one pass per second. The same wheel speed and workpieces described above were used for this test. Using a pneumatic piston feed, the workpieces were plunged into the face of the wheel at a constant force in a range of about 20 to 30 (e.g., about 25) psi pressure. This value represents the pressure (force/area) that the workpiece exerts on the wheel.

The grinding continued until about one linear inch of the workpiece was consumed, for a total stock removal of about 1 $in^3$. The workpieces were weighed and remounted after a pause of about 10 seconds. This procedure was repeated twice more times (3 total) before a new workpiece was tested. The grinding continued until it took about 60 seconds to remove 1 $in^3$ of metal.

As shown in FIG. 4, conventional wheels 41 removed about 4,800 g (4.8 kg) of metal before needing to be dressed. Since the test is grinding at a constant pressure, the metal-removal rate is a measure of the wheel sharpness. Their initial sharpness (see vertical axis) was about 2.36 $in^3$/min. In contrast, embodiments 43 disclosed herein removed about 11.9 kg of metal before needing to be dressed. In addition, their initial sharpness was about 2.79 $in^3$/min.

Other embodiments of floorstand foundry abrasive wheels may comprise outer diameters in a range of about 10 inches to 36 inches. The axial thicknesses or widths of these wheels may range from about one inch to three inches. The spindle or hole size may range from about 1.25 inches to about 12 inches. For example, two of the wheel sizes may comprise 30"×2"×12", or 24"×3"×12".

The grit size for various embodiments disclosed herein may comprise primary abrasives having a grit size of about 10 to 16, and secondary abrasives having a grit size of about 10 to 14, 12 to 16, or still other grit sizes ranging to 24 grit. The metric equivalents of these grit sizes are approximately as follows: 10 grit=3460 microns, 12 grit=2550 microns, 14 grit=2100 microns, 16 grit=1660 microns, 20 grit=1340 microns, and 24 grit=1035 microns.

In more particular terms, the bonded abrasive articles of the embodiments herein may incorporate abrasive particles having an average particle size of at least about 100 microns, at least about 300 microns, at least about 500 microns, at least about 700 microns, at least about 800 microns, at least about 900 microns, or at least about 1000 microns. Still, in other instances, the average particle size of the abrasive grit can be not greater than about 5000 microns, not greater than about 4000 microns, or even not greater than about 3800 microns, not greater than about 3500 microns. It will be appreciated that the average particles size of the abrasive particles can be within a range between any of the minimum and maximum values noted above.

Embodiments disclosed herein may have grade and structure ranges. The grade and structure can describe the content of particular phases within the body, including the content of abrasive particles, bond material, and porosity, which together can account for the total volume (100%) of the body. Examples may include about 54 vol % to about 58 vol % abrasive, about 16 vol % to about 36 vol % bond, and about 10 vol % to about 26 vol % porosity.

According to one embodiment, the body can include a total content of abrasive particles collectively including at least a first type, second type, and third type of abrasive particles that is less than about 64 vol %, less than about 60 vol %, less than about 59 vol %, less than about 58 vol %, less than about 57 vol %, less than about 56 vol %, or less than about 55 vol % for the total volume of the body. In another embodiment the body includes a total content of abrasive particles of at least about 32 vol %, at least about 34 vol %, at least about 38 vol %, at least about 40 vol %, at least about 42 vol %, at least about 44 vol %, at least about 46 vol %, at least about 48 vol %, at least about 50 vol %, at least about 52 vol %, or at least about 54 vol % of the total volume of the body. It will be appreciated that the total content of abrasive particles within the body can be within a range between any of the minimum and maximum percentages noted above.

Moreover, the abrasive articles of the embodiments herein can have a body including a particular content of bond material. For example, the bond material can be present in amounts of at least about 5 vol % for the total volume of the body. In other instances, the amount of bond material can be greater, such as, at least about 6 vol %, at least about 8 vol %, at least about 10 vol %, at least about 12 vol %, at least about 14 vol %, or at least about 16 vol %. Still, the content of bond material can be less than about 38 vol %, less than about 30 vol %, less than about 25 vol %, less than about 21 vol %, or less than about 18 vol % bond material for the total volume of the body. It will be appreciated that the total content of bond material within the body can be within a range between any of the minimum and maximum percentages noted above.

The bond material can include a mixture of bond composition material and fillers. The bond composition can include a resin, and particularly a phenolic resin. The fillers can include any one or more materials such as inorganic fillers. For example, iron pyrite ($FeS_2$), potassium sulfate ($K_2SO_4$), cryolite ($Na_3AlF_6$), potassium aluminum fluoride ($KAlF_4$), calcium fluoride ($CaF_2$), and/or lime (CaO) may be used. In certain instances, the bond material can include an equal amount by weight, of the resin and the fillers. For example, in one embodiment, the bond material includes about 51 wt % phenolic resin, and about 49 wt % of fillers, and the fillers comprise about 32 wt % $FeS_2$ and about 18 wt % of $K_2SO_4$.

The abrasive articles of the embodiments herein can have a body including a particular content of porosity. For example, the amount of porosity can be at least about 2 vol % for the total volume of the body. In other instances, the amount of porosity can be greater, such as, at least about 4 vol %, at least about 6 vol %, at least about 8 vol %, or even at least about 10 vol %. Still, the content of porosity can be less than about 34 vol %, less than about 32 vol %, less than about 30 vol %, less than about 25 vol %, less than about 20 vol %, less than about 15 vol %, or even less than about 12 vol %. It will be appreciated that the total content of porosity within the body can be within a range between any of the minimum and maximum percentages noted above.

According to one embodiment, a portion of the porosity is closed porosity, such that the porosity is defined by discrete and separate pores, which are not interconnected with each other. In one particular instance, a majority of the porosity within the body can be closed porosity, and even substantially all of the porosity can be closed porosity.

The sources of the various raw materials disclosed herein may comprise the following: Varcum 29344 from Durez Corporation; Pyritemax 8520 from Prince Minerals, Inc.; potassium sulfate SOP-3 from Big Quill Resources, Inc.; ZF Alundum from Saint-Gobain Ceramic Materials Canada Inc.; Mono Abrax-88 from Saint-Gobain Ceramic Materials Zhengzhou Co., Ltd.; and Duralum Redkote from Washington Mills Electro Minerals Corporation.

The bonded abrasive articles of the embodiments herein are understood to include fixed abrasive materials including abrasive particles contained within a bond material matrix. The bond material matrix can form a three-dimensional network of material surrounding and encompassing the abrasive particles, which can be distinct from single-layered and coated abrasive articles.

In still other embodiments, a dressable bonded abrasive article comprises a body including: a bond material comprising an organic material; a first type of abrasive particle comprising an oxide; a second type of abrasive particle comprising an oxide and different than the first type of abrasive particle; and the body comprises an average metal removal capability of at least about 5 kg between dressings. The abrasive particles may be provided as a blend. The average metal removal capability also may comprise at least about 6 kg between dressings, at least about 8 kg between dressings, at least about 9 kg between dressings; at least about 10 kg between dressings, or at least about 11 kg between dressings. These figures may be based on the tests described herein.

The body may require at least about 10%, at least about 20%, at least about 30%, or at least about 40% fewer dressings than a conventional foundry abrasive grinding wheel. The conventional foundry abrasive grinding wheel may comprise about 45% alumina zirconia and about 55% ceramic coated alumina. For example, in one experiment, an embodiment required only 20 dressings instead of 35 for a conventional wheel. The ceramic coating on the alumina may comprise $Fe_2O_3$ in an inorganic matrix (e.g., a glass bond such as $Na_2SiO_3$). See, e.g., U.S. Pat. No. 2,527,044, which is incorporated herein by reference in its entirety.

In other embodiments, the first type of abrasive material can include an oxide, which can include aluminum. For example, the first type of abrasive material can include alumina or zirconia. Still, in other instances, the first type of abrasive can include a combination of oxide compounds, including for example a combination of alumina and zirconia, wherein the first type of abrasive particle can be made of a majority content of alumina. In particular examples, the first type of abrasive particle can include a majority content of alumina, such that, for example, the abrasive particles of the first type contain not greater than about 40 wt % zirconia, not greater than about 30 wt % zirconia, or even not greater than about 20 wt % zirconia.

The second type of abrasive particle can include an oxide, and may include alumina, and more particularly can be monocrystalline alumina.

Embodiments of the first type of abrasive particle can have a first hardness that is at least about 5% less than a hardness of the second type of abrasive particle, at least about 8% less than, at least about 10% less than, at least about 12% less than or at least about 15% less than a hardness of a second type of abrasive particle. In certain other instances, the first hardness is not greater than about 40%, not greater than about 35%, not greater than about 30%, not greater than about 25%, or not greater than about 20% less than the hardness of the second type of abrasive particle. In one particular example, the first hardness of the first type of abrasive particle can be within a range of about 15% to about 20% less than the second hardness of the second type of abrasive particle.

Other embodiments of the first type of abrasive particle comprise a hardness of at least about 10 GPa, at least about 11 GPa, at least about 12 GPa, at least about 13 GPa, at least about 14 GPa, or at least about 15 GPa. Still other embodiments of the first type of abrasive particle comprise a hardness of not greater than about 25 GPa, not greater than about 23 GPa, not greater than about 20 GPa, not greater than about 19 GPa, not greater than about 18 GPa, or not greater than about 17 GPa. The hardness testing may be completed as per ASTM C1327: Standard Test Method for Vickers Indentation Hardness of Advanced Ceramics.

The second type of abrasive particle may comprise a hardness of at least about at least about 17 GPa, at least about 18 GPa, at least about 19 GPa, or at least about 20 GPa. Embodiments of the second type of abrasive particle may comprise a hardness of not greater than about 23 GPa, not greater than about 22 GPa, or not greater than about 21 GPa. For example, in some embodiments, average values for toughness and hardness may be defined as follows (see, e.g., FIG. 2):

| | Particle 24 (conventional) | Third Particle 25 | Second Particle 23 | First Particle 21 |
|---|---|---|---|---|
| Toughness KIC (MPa m0.5) | 2.37 | 1.62 | 1.70 | 3.32 |
| Hardness (GPa) | 15.74 | 16.58 | 18.58 | 15.32 |

In addition, the first type of abrasive particle may have a first toughness that is about 80%, about 90%, or about 100% greater than a second toughness of the second type of abrasive particle. An equation that may be used to calculate this difference comprises: [(T1−T2)/T2]×100%, where T1 is first toughness of first particle, T2 is second toughness of second particle. The toughness test may be measured by "A Critical Evaluation of Indentation Techniques for Measuring Fracture Toughness: I, Direct Crack Measurements," by Anstis, et al; J of the American Ceramic Society, Vol 64, No. 9 (September 1981).

Embodiments of the bond material may comprise a volume of the body that is less than about 38%, less than about 30%, less than about 25%, less than about 21%, or less than about 18%. The bond material may comprise, by weight, about half resin and about half fillers. For example, one embodiment of the bond material is about 51 wt % phenolic resin, and about 49 wt % of fillers, and the fillers comprise about 32 wt % $FeS_2$ and about 18 wt % of $K_2SO_4$. In addition, the body may comprise a closed porosity of less than about 30%, less than about 25%, less than about 20%, less than about 15%, or less than about 12%.

Other embodiments further comprise a third type of abrasive particle, such as an oxide, alumina, or consisting essentially of alumina (e.g., ceramic coated alumina). The first, second and third types of abrasive particles may be formed from a fused process. In some embodiments, a "fused" abrasive is fabricated by melting the raw materials (e.g., primarily bauxite for $Al_2O_3$) and then solidifying them in a purer form. The melting may be performed in an electric arc furnace.

For example, the body may comprise the following volumetric percentages: about 30% to about 36% of each of the first, second and third types of abrasive particles. The body also may comprise about a third of each of the first, second and third types of abrasive particles. The body also may comprise the following volumetric percentages: about 33% alumina zirconia, about 33% monocrystalline alumina, and about 34% ceramic coated alumina, and a total volume of alumina grains content in the body may be about 33% to 67%. The first, second and third types of abrasive particles may collectively comprise a volume of the body that is less than about 60%, less than about 59%, less than about 57%, less than about 56%, or less than about 55%.

The third type of abrasive particle may have a third hardness that is at least about 10% less than a second hardness of the second type of abrasive particle, the second type of abrasive particle has a second toughness, the third type of abrasive particle has a third toughness, and a percentage difference between the second toughness and the third toughness is not greater than about 10%. The first type of abrasive particle may not be greater than about 3.5 mm and is the largest of the three types of particles. In addition, the first, second and third types of abrasive particles may comprise the following respective grit sizes: 10, 12 and 14; or 12, 14 and 16; 14, 16 and 20; or 16, 20 and 24.

In another embodiment, a dressable bonded abrasive article comprises a body including: a bond material comprising an organic material; and a blend of abrasive particles comprising at least a first type of abrasive particle comprising an oxide and a second type of abrasive particle comprising an oxide and different than the first type of abrasive particle; and the body has an initial removal rate of at least about 2.4 $in^3$/min of material removed from a workpiece at 25 psi of pressure. The initial material removal rate also may be at least about 2.5 $in^3$/min, at least about 2.6 $in^3$/min, or at least about 2.7 $in^3$/min. The work pieces may comprise ductile iron. These values may vary for other materials such as grey iron or cast steel.

Still another embodiment of a dressable bonded abrasive article comprises a body including: a bond material comprising an organic material; and a blend of abrasive particles comprising: a first type of abrasive particle comprising an oxide and having a first hardness and a first toughness; a second type of abrasive particle comprising an oxide and having a second hardness greater than the first hardness, and the second type of abrasive particle has a second toughness less than the first toughness; and a third type of abrasive particle comprising an oxide and having a third hardness greater than the first hardness and less than the second hardness, and the third type of abrasive particle has a third toughness less than the first toughness.

A dressable bonded abrasive article also may comprise a body including: a bond material comprising an organic material; a first type of abrasive particle comprising an oxide; a second type of abrasive particle comprising an oxide and different than the first type of abrasive particle; and the body comprises an average metal removal capability of at least about 4 kg of material removed between dressings at about 60 psi pressure, with a standard deviation of no more than about 2 kg. See hydraulic test described herein.

Other examples of the average metal removal capability comprise at least about 4.5 kg between dressings, at least about 5 kg between dressings, or at least about 5.25 kg between dressings. The standard deviation also may be no more than about 1.5 kg, no more than about 1.0 kg, no more than about 0.75 kg, or no more than about 0.5 kg.

The dressable bonded abrasive article also may comprise a body with an average metal removal capability that is at least about 4% greater than that of a conventional foundry abrasive grinding wheel, wherein the conventional foundry abrasive grinding wheel comprises about 45% alumina zirconia and about 55% ceramic coated alumina. Referring to FIG. 4, this value may be calculated by comparing the material removed by the conventional wheel (about 4.8 kg) to that of embodiments disclosed herein. For example, when an embodiment removes 5.0 kg of material, a 4% improvement is effected, and when an embodiment removes 11.5 kg of material, a 129% improvement is effected compared to the conventional wheel removal rate.

In other examples, the average metal removal capability may be at least about 25%, at least about 60%, at least about 85%, at least about 105%, or at least about 125% greater than that of the conventional foundry abrasive grinding wheel.

Other embodiments of the dressable bonded abrasive article for use in foundry grinding applications comprise a body with an initial removal rate that is at least about 8% greater than that of a conventional foundry abrasive grinding wheel, wherein the conventional foundry abrasive grinding wheel comprises about 45% alumina zirconia and about 55% ceramic coated alumina. The initial removal rate also may comprise at least about 10%, at least about 15%, at least about 20%, at least about 25%, or at least about 30% greater than that of the conventional foundry abrasive grinding wheel. As shown along the vertical axis of FIG. 4, this value may be calculated by comparing the range of MRR of the conventional wheel (about 2.2 $in^3$/min to about 2.5 $in^3$/min) to that of embodiments disclosed herein.

For example, as shown in FIG. 4, when an embodiment removes about 2.7 $in^3$/min, an 8% improvement is effected over the maximum MRR of the conventional wheel (about 2.5 $in^3$/min), and when an embodiment removes about 2.9 $in^3$/min of material, an improvement of about 32% is effected over the minimum MRR of the conventional wheel (about 2.2 $in^3$/min).

Another example includes a body comprising an average metal removal capability that is at least about 9% greater than that of a conventional foundry abrasive grinding wheel, wherein the conventional foundry abrasive grinding wheel comprises about 45% alumina zirconia and about 55% ceramic coated alumina. In other versions the average metal removal capability is at least about 23%, at least about 35%, or at least about 40% greater than that of the conventional foundry abrasive grinding wheel.

The embodiments disclosed herein have numerous advantages compared to conventional foundry wheels. These embodiments of foundry wheels are more consistent at the point at which they dull. Such wheels dull with consistency and with a low variability or standard deviation of dulling. Thus, the embodiments are easier to use than conventional wheels, which enable operators to operate the equipment more efficiently with fewer required dressings.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the orders in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A dressable bonded abrasive article comprising:
a body including:
a bond material comprising an organic material;
a first type of abrasive particle comprising an oxide;
a second type of abrasive particle comprising an oxide and different than the first type of abrasive particle;
the body comprises an average metal removal capability of at least about 5 kg between dressings; and
the first type of abrasive particle has a first hardness that is at least about 5% less than a hardness of the second type of abrasive particle, and further wherein the first hardness is not greater than about 40% less than the hardness of the second type of abrasive particle.

2. An article according to claim 1, wherein the average metal removal capability comprises at least about 6 kg between dressings.

3. An article according to claim 1, wherein the body requires at least about 10% fewer dressings than a conventional foundry abrasive grinding wheel.

4. An article according to claim 1, wherein the first type of abrasive particle comprises alumina and zirconia, wherein the first type of abrasive particle comprises not greater than about 40 wt % zirconia, and wherein the second type of abrasive particle comprises monocrystalline alumina.

5. An article according to claim 1, wherein the first type of abrasive particle comprises a hardness of at least about 10 GPa.

6. An article according to claim 1, wherein the first type of abrasive particle comprises a hardness of not greater than about 25 GPa.

7. An article according to claim 1, wherein the second type of abrasive particle comprises a hardness of at least about at least about 17 GPa.

8. An article according to claim 1, wherein the second type of abrasive particle comprises a hardness of not greater than about 23 GPa.

9. An article according to claim 1, wherein the body comprises less than about 38 vol % bond material for a total volume of the body.

10. An article according to claim 1, wherein the bond material comprises a mixture of bond composition and fillers, wherein the bond composition includes a resin, and the bond material comprises about an equal amount by weight, of the resin and the fillers.

11. An article according to claim 1, wherein the body comprises a porosity of less than about 30%, and a portion of the porosity is closed porosity.

12. An article according to claim 1, further comprising a third type of abrasive particle.

13. An article according to claim 12, wherein the third type of abrasive particle comprises a coated abrasive particle including a core and a coating layer overlying the core, wherein the core comprises alumina, wherein the coating layer comprises a material selected from the group consisting of oxides, carbides, nitride, borides, and a combination thereof.

14. An article according to claim 12, wherein the first, second and third types of abrasive particles are formed from a fused process.

15. An article according to claim 12, wherein the body comprises a total content of abrasive particles, and the total content of abrasive particles includes at least about 10% of the first type of abrasive particles, and not greater than about 45% of the first type of abrasive particles.

16. An article according to claim 12, wherein the body comprises about a third of each of the first, second and third types of abrasive particles.

17. An article according to claim 12, wherein the body comprises the following volumetric percentages: about 33% alumina zirconia, about 33% monocrystalline alumina, and about 34% ceramic coated alumina.

18. An article according to claim 12, wherein the body comprises less than about 64 vol % of a total content of abrasive particles for the total volume of the body, wherein the total content of abrasive particles includes content of the first type, second type, and third type of abrasive particles collectively, and wherein the body comprises at least about 32 vol % of the total content of abrasive particles for the total volume of the body.

19. An article according to claim 12, wherein the third type of abrasive particle has a third hardness that is at least about 10% less than a second hardness of the second type of abrasive particle, the second type of abrasive particle has a second toughness, the third type of abrasive particle has a third toughness, and a percentage difference between the second toughness and the third toughness is not greater than about 10%.

20. An article according to claim 12, wherein the first type of abrasive particle comprises an average particle size of not greater than about 3.5 mm, the first type of abrasive particle comprises an average particle size greater than an average particle size of the second type of abrasive particle, the first type of abrasive particle comprises an average particle size greater than an average particle size of the third type of abrasive particle, and the second abrasive particle comprises an average particle size greater than an average particle size of the third type of abrasive particle.

21. A dressable bonded abrasive article comprising:

a body including:

a bond material comprising an organic material;

a first type of abrasive particle comprising an oxide;

a second type of abrasive particle comprising an oxide and different than the first type of abrasive particle;

the body comprises an average metal removal capability of at least about 5 kg between dressings; and the first type of abrasive particle has a first toughness that is at least about 80% greater than a second toughness of the second type of abrasive particle.

22. A dressable bonded abrasive body, comprising:

a bond material comprising an organic material;

a first type of abrasive particle comprising alumina and zirconia;

a second type of abrasive particle comprising monocrystalline alumina;

a third type of abrasive particle comprising a coated abrasive particle having a core of alumina, and a coating layer overlying the core, wherein the coating layer comprises one or more of ceramic, crystalline material, glass, oxide, carbide, nitride and boride; and the first type of abrasive particle comprises an average particle size of not greater than about 3.5 mm, the average particle size of the first type of abrasive particle that is greater than an average particle size of the second type of abrasive particle, the average particle size of the first type of abrasive particle is greater than an average particle size of the third type of abrasive particle, and the average particle size of the second abrasive particle is greater than the average particle size of the third type of abrasive particle.

23. A body according to claim 22, wherein the body comprises:

about 54 vol % to about 58 vol % of a combination of the first, second and third types of abrasives, of which the body comprises about a third of each of the first, second and third types of abrasive particles;

about 16 vol % to about 36 vol % of the bond material; and about 10 vol % to about 26 vol % porosity.

* * * * *